United States Patent [19]

Stohlquist et al.

[11] 4,231,560

[45] Nov. 4, 1980

[54] TENSION CONTROLLED APPARATUS FOR FEEDING WEB MATERIAL

[75] Inventors: Roger H. Stohlquist; Leo Strombeck, both of Rockford, Ill.

[73] Assignee: Anderson Bros. Mfg. Co., Rockford, Ill.

[21] Appl. No.: 929,168

[22] Filed: Jul. 28, 1978

[51] Int. Cl.[3] ..... B65H 45/22

[52] U.S. Cl. ..... 493/29; 53/568; 226/37; 493/439

[58] Field of Search ..... 270/41, 86, 94, 31; 226/34, 37, 38, 25, 35

[56] References Cited

U.S. PATENT DOCUMENTS

| | | | |
|---|---|---|---|
| 1,801,939 | 4/1931 | Sopkin | 74/213 |
| 2,918,769 | 12/1959 | Anderson | 53/178 |
| 2,999,685 | 9/1961 | Burki | 270/86 |
| 3,045,405 | 7/1962 | Anderson et al. | 53/182 R |
| 3,160,409 | 12/1964 | Lucas | 270/41 |
| 3,656,674 | 4/1972 | Morse | 226/37 |
| 3,878,979 | 4/1975 | Cristiani | 226/34 |
| 4,004,400 | 1/1977 | Anderson et al. | 53/182 R |

*Primary Examiner*—Robert E. Bagwill
*Attorney, Agent, or Firm*—Morsbach & Pillote

[57] ABSTRACT

A tension controlled apparatus for feeding web material from a supply source to processing equipment of the type that exerts a pulling force on the web, the apparatus including a drive wheel and a driven wheel mounted for rotation about an axis parallel to the drive wheel and for shifting movement toward and away from the drive wheel, a web feed roller connected coaxially to the driven wheel for rotation thereby and means for guiding the web material to cause it to wrap part way around the web feed roller as it passes from the supply source to the processing equipment and exits from the web feed roller in an exiting direction having a substantial component in a direction to shift the driven wheel into driving engagement with the drive wheel in response to tension applied by the processing machine on the web of material exiting from the feed roller.

8 Claims, 6 Drawing Figures

52
51
12
37
16
14
14a
4
45
25
44
13
48
39
40
41
46
38
37
We
58
41
25
27
75
23
29
26
72
32
28
74
57
71'
11
10
71
61'
62
63
61
R'
51
62
63
16
12
We
45
10
11
61'
2
2
44
23
75
3
3

TENSION CONTROLLED APPARATUS FOR FEEDING WEB MATERIAL

BACKGROUND OF THE INVENTION

Some web processing machines, for example article wrapping machines of the type disclosed in U.S. Pat. Nos. 2,918,769; 3,045,405 and 4,004,400, exert a pulling force on the web to advance the web through the processing machine. However, it is frequently desirable to assist feeding of the web material to the processing machine at a rate correlated with the rate of advance of the web by the processing machine. In U.S. Pat. No. 2,918,769 there is disclosed a web feed apparatus for feeding a plurality of webs to a multi-web wrapping machine in which the webs, after being longitudinally folded, are passed over a continuously rotating feed roller. When the web processing machine pulls on the web, the web is drawn against the continuously rotating feed roller which then operates to advance the same until the tension on the exiting web is reduced to a sufficiently low value that the roller merely slips relative to the web. In addition, provision was made for driving the web supply roll to overcome the inertia problems in starting and stopping unwinding rotation of the supply roll and to maintain a storage loop of web material under low tension. As disclosed more fully in that patent, the web supply roll was supported on a pair of drive rollers that were connected through a clutch mechanism to a continuously rotating drive shaft and the clutch mechanism was operated by a mechanism responsive to the tension in the web exiting from the roll to start and stop the drive rollers to maintain a slack loop of web material between the supply roll and the web feed roller. The web feed apparatus disclosed in U.S. Pat. No. 2,918,769 worked well with some web material such as coated paper and the like. However, difficulties were encountered with relatively stretchable thin and plastic films such as polyethylene, polypropylene, etc. It was found that the plastic film material would sometimes tend to adhere to the continuously rotating feed roller and wrap around the roller causing a jam-up in the machine. Attempts to overcome this problem by use of a clutch operated in timed relation with the advance of the wrapping machine to start and stop the feed rollers, were not successful.

SUMMARY OF THE INVENTION

It is an object of the present invention to overcome the disadvantages of the prior art by providing an apparatus for feeding webs to a processing machine of the type that exerts a pulling force on the web, in which driving of a web feed roller is automatically controlled in response to the tension in the web to feed the web at a rate correlative with the rate at which the web is advanced by the web processing machine.

Another object of this invention is to provide a tension controlled apparatus for feeding a plurality of webs to a multi-lane wrapping machine of the type that exerts a pulling force on the web and in which individual web feed rollers are provided for each of the webs and the driving of each feed roller is substantially controlled in response to the tension in the respective web to feed the webs to the wrapping machine at a rate to maintain a low generally uniform tension on the webs supplied to the wrapping machine.

A further object of this invention is to provide a tension controlled web feed apparatus which is of simple and economical construction.

Accordingly, the present invention provides a tension controlled apparatus for feeding of web material from a supply source to a processing equipment of the type that exerts a pulling force on the web, which apparatus includes a drive wheel mounted for axial rotation and drive means for driving the drive wheel, a driven wheel mounted for rotation about an axis parallel to the drive wheel and for shifting movement bodily along a path forward and away from the drive wheel, a web feed roller connected coaxially to the driven wheel for rotation thereby, and means for guiding the web of material to cause it to wrap part way around the web feed roller as it passes from the supply source to the processing equipment and to exit from the web feed roller in an exiting direction having a substantial component along said path and in a direction to shift the driven wheel into driving engagement with the drive wheel when tension is applied by the processing machine on the web of material exiting from the feed roller.

The tension control apparatus for feeding the web of materials advantageously utilized to feed a plurality of webs of material from plural supply sources to a multi-lane wrapping machine in such a manner as to maintain a low substantially constant tension on the webs of material fed to the wrapping machine, notwithstanding the intermittent advance material by the wrapping machine.

These, together with other features and advantages of this invention will be more readily understood by reference to the following detailed description, when taken in connection with the accompanying drawings wherein.

Figures 1, 2:
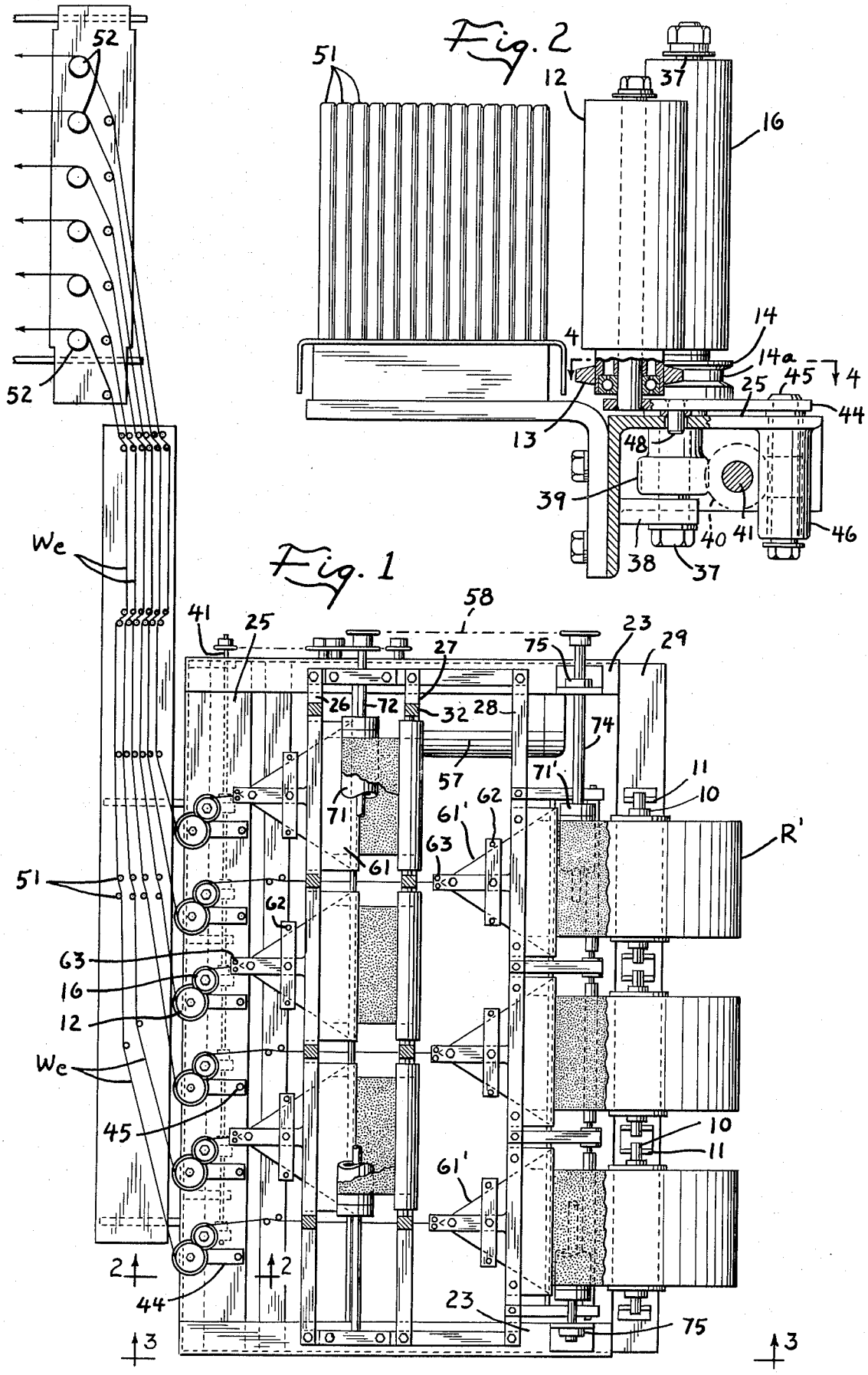
FIG. 1 is a top plan view of a tension controlled apparatus for feeding web material according to the present invention.
FIG. 2 is a fragmentary vertical sectional view taken on the plane 2—2 of FIG. 1 and illustrating the feed rollers on a larger scale.

The present invention relates to an apparatus for feeding a web of material from a supply source such as a roll of the web material to a web processing equipment of the type that exerts a pulling force on the web and is specifically designed for use in feeding a plurality of webs of material to a multi-lane wrapping machine which is intermittently operated to advance the web therethrough. The multi-lane wrapping machine may, for example, be of the type disclosed in the U.S. Patent to Ralph F. Anderson and Leo Strombeck, U.S. Pat. No. 4,004,400 issued Jan. 25, 1977, the disclosure of which is hereby incorporated herein by reference. As more fully disclosed in the aforementioned patent, the wrapping machine is of a multi-lane type for simultaneously receiving and wrapping a plurality of articles corresponding to the number of lanes in the wrapping machine. In general, the article wrapping machine is arranged to receive a plurality of longitudinally folded strips of wrapping material at the inlet end of the machine, open the folded strips into upwardly opening U-shaped channels as the strips are advanced past an article depositing station A; longitudinally fold the strips into a tube around the article at a longitudinal folding station B; longitudinally seam the tube at a seaming station C and transversely seal and sever the tubes between adjacent articles at a transverse sealing and severing station D. In the embodiment shown, the transverse sealing and severing station includes upper and lower jaw assemblies E and F operative to grip the enfolded tubes therebetween and advance the strips of wrapping material through the wrapping machine, and a transverse sealing and severing mechanism G operated in timed relation with the upper and lower jaw assemblies to seal and sever the wrapper while it is gripped between the jaw assemblies. An article stop or positioning mechanism J is operated in timed relation with the operation of the machine to engage the articles in the strips of wrapping material and to release the articles at the proper time in the cycle to space the articles along the wrappers.

The web feed apparatus is arranged to feed webs from a supply source such as a roll of web material to the processing machine at a low substantially uniform tension. The web feed apparatus is arranged to support a number of rolls of web material corresponding to the number of lanes of the wrapping machine and, in the embodiment illustrated, it is arranged to support six rolls of web material for a six-lane wrapping machine. The rolls of web material are supported for independent unwinding rotation and each roll is mounted on a mandrel 10 supported in trunnions 11. The web feed apparatus includes a support frame having upright legs 21, cross members 23, 24 and longitudinal frame membrs 25, 26, 27, 28 and 29. In order to reduce the overall size of the web feed apparatus, one group of web supply rolls R are supported by brackets 31 attached to longitudinal frame members 26 and 27, at a level above the frame. Another group of web supply rolls R′ are supported by standards 33 on the longitudinal frame member 29 adjacent the rear side of the frame.

Figure 5:
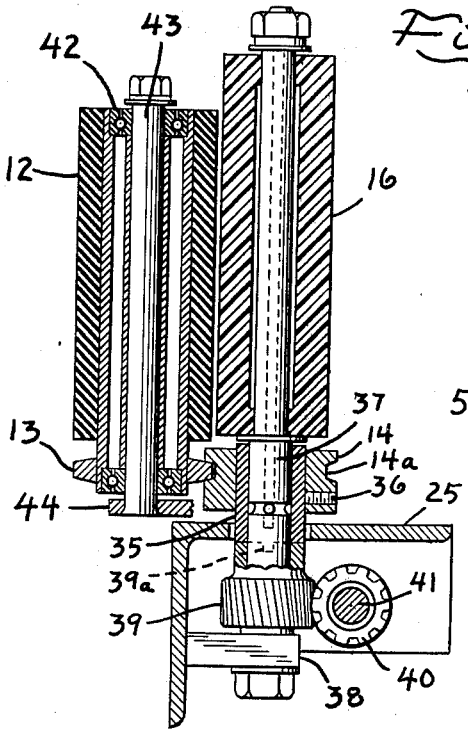
FIG. 5 is a fragmentary vertical sectional view taken on the plane 5—5 of FIG. 4.
Figure 4:
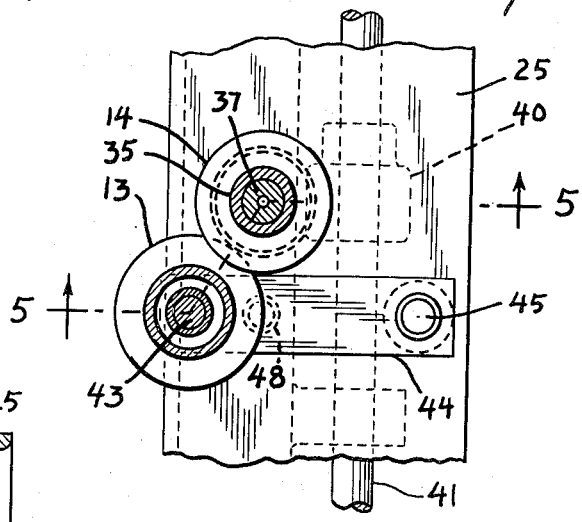
FIG. 4 is a fragmentary horizontal sectional view taken on the plane 4—4 of FIG. 2.

A plurality of web feed rollers 12 are provided, one for each lane of the wrapping machine, and provision is made for driving the web feed rollers under the control of the tension on the web as it exits from the web feed rollers. For this purpose, each web feed roller 12 has a wheel 13 connected thereto adjacent one end for rotation by the wheel 13 and each web feed roller and its associated wheel 13 are supported for shifting movement along a path into and out of driving engagement with a respective drive wheel 14. As best shown in FIGS. 2, 4 and 5, the drive wheels 14 are fixedly attached to sleeves 35 as by set screws 36, and the sleeves 35 are rotatably supported on upright spindles 37. Spindles 37 are conveniently secured to a bracket 38 on the frame member 25, and a drive gear 39 is rotatably supported on each spindle below the sleeve 35 and non-rotatably keyed to the sleeve as indicated at 39*a* to drive the sleeve and drive wheel 14. A plurality of gears 40 are mounted on a shaft 41 and each mesh with a respective one of the gears 39 to drive the drive wheels 14. Each drive wheel 14 is arranged to frictionally drive an associated one of the wheels 13 when the latter is moved into engagement therewith, and any suitable frictional drive surfaces may be provided on the wheels 14 and 13. However, the wheels 14 and 13 are preferably wedge-surfaced friction wheels in which one of the wheels such as 14 is provided with one or more grooves 14*a* with side walls that converge toward the wheel axis at a shallow angle and the other wheel such as 13 is formed with tapered side walls that converge in a direction away from the wheel axis to be received in the tapered groove in the wheel 14. Such wedge surfaced friction wheels give greater resistance to slipping with a given radial pressure therebetween and can transmit a relatively high drive torque with a relatively low radial pressure.

The feed rollers 12 are each rotatably supported as by bearings 42 on a spindle 43 for rotation about an axis parallel to the axis of the associated drive roller 14 and each spindle 43 is mounted as on an arm 44 for movement along a path toward and away from an associated drive roller 14. The arms 44 are preferably swingably supported for movement toward and away from their associated drive roller and, as shown in FIGS. 2 and 4, each of the arms are provided with a pintle 45 at the end remote from the spindle 43, which pintle is rotatably supported in a housing 46 attached to the longitudinal frame member 25. A yieldable biasing means can be provided to yieldably bias the associated arm 44 in a direction away from the drive roller 14. However, it has been found that such a biasing means is not essential and that the driven roller will automatically move out of driving engagement with the drive roller when the web tension approaches zero. A stop pin 48 is provided on each arm and extends through an elongated slot 49 in the frame member 25 to limit movement of the arm in a direction away from the associated drive wheel.

Means are provided for guiding the webs of material to cause each web to wrap part way around a respective one of the web feed rollers 12 and exit therefrom in an exiting direction having a substantial component in a direction to shift the feed roller 12 and the driven wheel 13 connected thereto into engagement with the associated drive wheel 14 when tension is applied to the web. As best shown in FIG. 1, the feed rollers 12 are offset to one side of the associated drive wheel 14 and the exiting web designated We exits from each of the feed rollers in a direction such that the exiting web has a substantial component perpendicular to the feed roll support arm 44 and which tends to urge the feed roll into driving engagement with the drive wheel, when tension is applied by the processing machine to the web exiting from the feed roller. For reasons pointed out hereinafter, each exiting web We passes over a plurality of guide pins 51 to an idler roller 52 mounted on the wrapping machine, which idler rollers are positioned in alignment with a respective one of the lanes of the wrapping machine. The feed roller 12 is preferably formed with a high friction outer surface such as rubber to enhance feeding of the web, and an idler roller 16 is advantageously mounted for free rotation on each of the spindles 37 coaxial with a respective one of the drive wheels 14. The webs from the respective supply sources are guided so that they pass part way around the idler roll and between the idler roller and the associated feed roller and part way around the feed roller in an S-wrap. This increases the amount of wrap of each web around its respective feed roller so as to increase the frictional drive between the feed roller and web. The idler roller does not drive the web and can be formed of a material such as plastic having a low friction surface.

Figure 3:
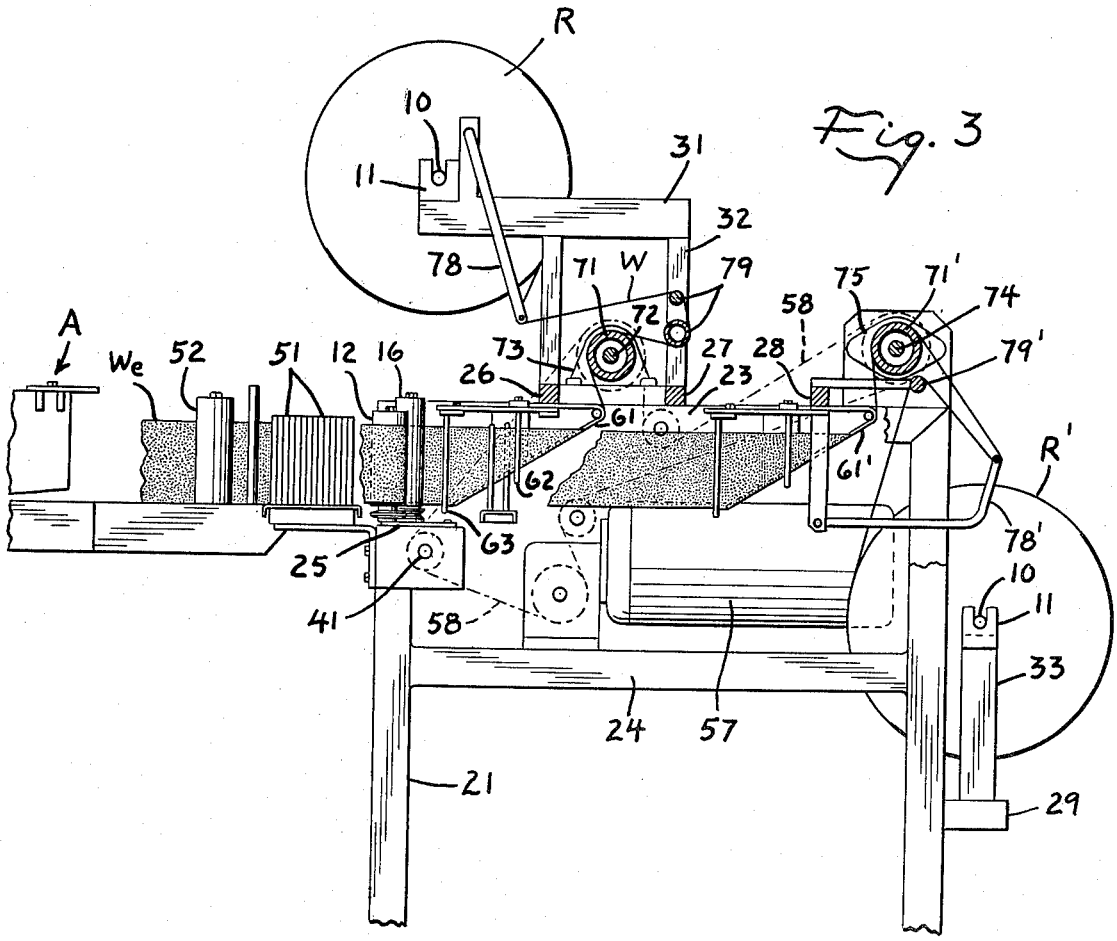
FIG. 3 is an end elevational view taken on the plane 3—3 of FIG. 1, with parts broken away and shown in section to illustrate details of construction.
Figure 6:
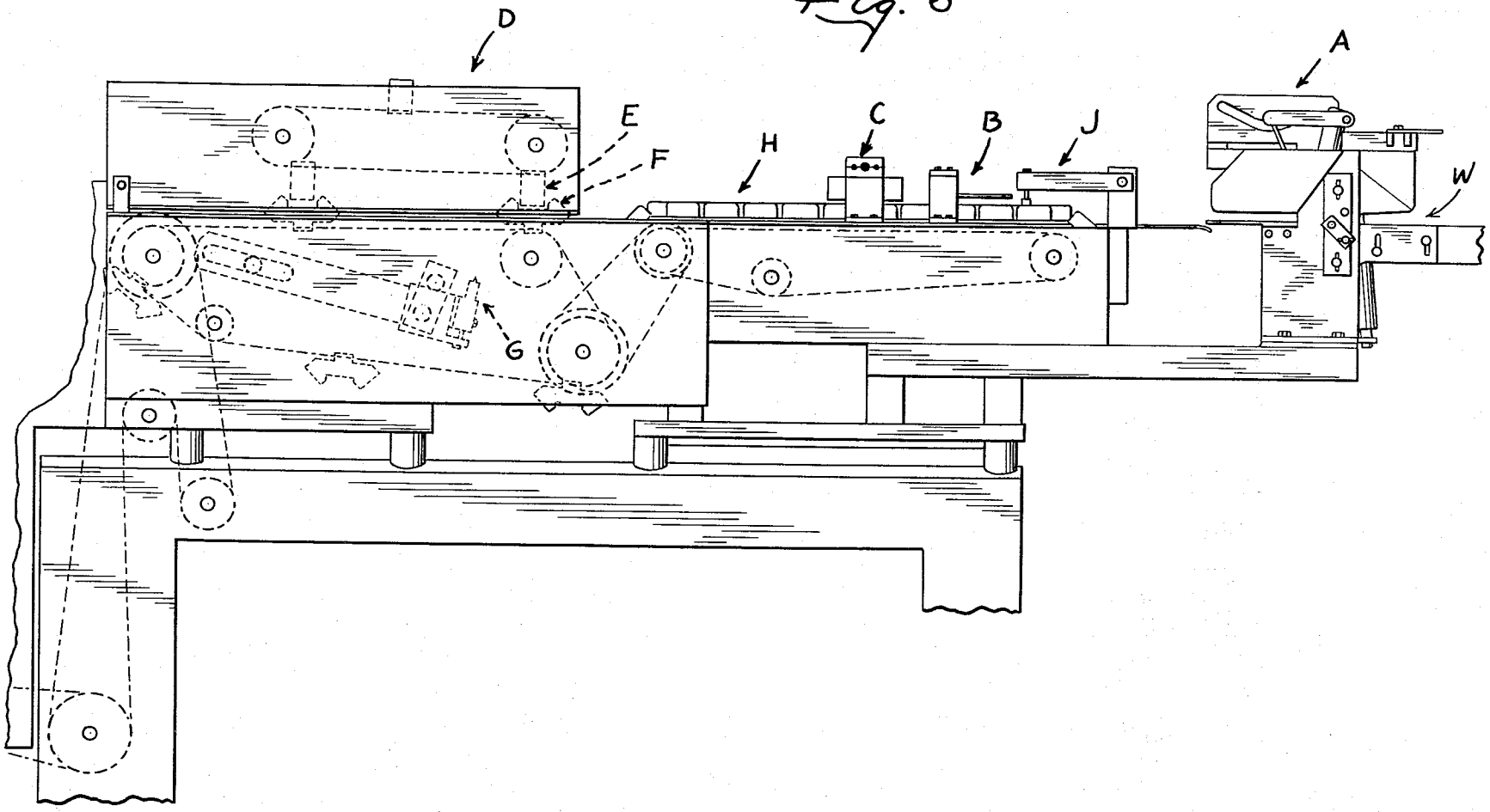
FIG. 6 is a side elevational view of a multi-lane article wrapping machine with which the feed apparatus is adapted for use.

The wrapping machine is arranged to receive webs which have been longitudinally folded into face-to-face contact and the wrapping machine is operative to open the webs to form an upwardly opening channel as they are advanced past the article depositing station, and to enfold the edges of the webs and longitudinally seal the same as they advance past the folding and sealing stations B and C. Longitudinal folding of the web is advantageously effected in advance of the web feed rollers 12 and, as shown in FIGS. 1 and 3, a plurality of generally V-shaped folding shoes 61, 61' are mounted on the frame of the feed apparatus and arranged to longitudinally fold the webs of material into face-to-face contact as the webs are drawn thereover. The V-shaped folding shoes are preferably mounted with their apices substantially aligned in the path of travel of the web with the side of a respective one of the idler rollers 16 so that the longitudinally folded web passes in a substantially straight line from the V-shaped folding shoe to the respective idler roller. In order to minimize the overall size of the web feed apparatus, the folding shoes are arranged in groups that are offset or staggered relative to each other. One group of folding shoes 61 associated with web supply rolls R is mounted on the cross member 26 and a second group of shoes 61' associated with web supply rolls R' is mounted on the cross member 28 with the apices of shoes 61' of the last mentioned group positioned to feed the folded webs therefrom between the shoes 61 of the first mentioned group. Web guide fingers 62 and 63 are associated with each V-shaped folding shoe to aid in guiding the web during folding and to hold the side portions of the web in face-to-face contact after folding.

The wrapping machine operates to intermittently pull or advance the webs of wrapping material therethrough, with periods between each cycle in which the web remains stationary. The rolls of web material are frequently large and, in order to overcome the problem of the rotational inertia of the supply rolls, supply roll unwind mechanism is preferably provided for each web, to unwind material from each supply roll and maintain a slack loop of web material under relatively low tension between the supply roll and the web feed rollers 16. For this purpose, second web feed rollers 71 are provided and, as shown in FIGS. 1 and 3, one group of feed rollers 71 are mounted on a shaft 72 journaled in bearings 73 and a second group of the second feed rollers 71' are mounted on a shaft 74 journaled in bearings 75. The feed rollers 71 extend along the inlet ends of the V-shaped web folding shoes 61 and the webs exiting from the supply rolls R are each passed over a dancer arm 78 and over intermediate guide rollers 79 and part way around a respective one of the feed rollers 71. Feed rollers 71' extend along the inlet ends of the V-shaped web folding shoes 61' and the webs exiting from web supply rolls R' each pass over a dancer arm 78' and over intermediate guide rollers 79' and part way around a respective one of the rollers 71'. Feed rollers 71 and 71' are conveniently driven in continuous fashion and are operative to feed the webs passing thereover when the tension exceeds minimum value and to merely slip relative to the web when the tension decreases below the minimum value. The dancer arms 78, 78' are mounted so that they form a slack loop between the respective supply roll and the feed rollers 71, 71' and operate to increase the tension on the web as the slack loop decreases and conversely decreases the tension on the web when the slack loop increases.

As previously described, the gears 39 associated with each of the drive wheels 14 mesh with a gear 40 mounted on shaft 41. The shaft 41 is driven in continuous fashion as by a motor 57 and chain drive 58. The feed rollers 71, 71' for unwinding material from the supply rolls to form a slack loop therein, are also preferably driven in continuous fashion as by the chain drive 58 as best shown in FIG. 3. In order to inhibit the tendency of the film to wrap around the continuously rotating feed rollers 71, 71' when the web tension is reduced, the rollers are preferably formed of a relatively hard plastic material with a smooth relatively low friction surface.

From the foregoing it is thought that the construction and operation of the web feed apparatus will be readily understood. The wrapping machine operates to grip the enfolded tube of wrapping material and to intermittently pull the strips of wrapping material therethrough. The feed rolls 12 are shifted in response to a relatively low tension on the web as it exits from the feed rolls to the inlet of the wrapping machine, to a position in which the driven wheel 13 drivingly engages the drive wheel 14 to thereby feed the web of material to the wrapping machine. The feed rolls 12 are preferably driven at a speed slightly higher than the maximum speed at which the wrapping machine advances the web therethrough and, whenever the rate of feed of the webs by a feed roller exceeds the rate of advance of the web by the wrapping machine, the driven wheel 13 associated with that feed roller will shift in a direction away from the associated drive wheel 14 to either increase the slippage between the drive and driven wheels or to stop the drive of the wheel 13 altogether, as required to maintain the exiting web We at a substantially uniform tension. Thus, rotation of the feed rollers 12 is automatically started and stopped in response to the tension on the respective exiting web and, since rotation of the feed rollers stops when the web tension is reduced, the webs do not tend to wind around the feed rollers 12. The guide pins 51 are staggered, as shown in FIG. 1, to aid in holding the longitudinally folded webs in face-to-face contact. The web feed rollers 71, 71' operate under the tension controlled by the dancers 78 to unwind material from the respective supply roll and maintain a slack loop of web material between the supply roll and the feed rolls 12, so as to avoid overloading of the feed rolls 12.

The embodiments of the invention in which an exclusive property or privilege is claimed are defined as follows:

1. A tension controlled apparatus for feeding a web of material from a supply roll to processing equipment of the type that exerts an intermittent pulling force on the web to intermittently advance the web through the processing equipment, the apparatus including means for supporting a supply roll of web material for unwinding rotation, a first web feed roller mounted for axial rotation, a first web guide means for guiding the web after it unwinds from the supply roll to cause it to wrap part way around the first web feed roller, means for driving the first web feed roller in continuous fashion in a direction to feed the web passing thereover from the supply roll, the first web feed roller having a smooth low friction web engaging surface operative to feed the web passing thereover when the tension on the web exceeds a minimum value and to slip relative to the web when the web tension decreases below the minimum value, a drive wheel mounted for axial rotation and drive means for driving said drive wheel in continuous fashion, a driven wheel mounted for rotation about an axis parallel to said drive wheel and for shifting movement bodily along a path toward and away from said drive wheel, a second web feed roller connected coaxially to said driven wheel for rotation thereby, second web guide means for guiding the web of material to cause it to wrap part way around the second web feed roller as it passes from the first web feed roller to the processing equipment and exit from the second web feed roller in an exciting direction having a substantial component along said path and in a direction to shift the driven wheel along said path and into driving engagement with the drive wheel when tension is applied by the processing equipment on the web material exiting from the second web feed roller, the second web feed roller having a high friction web engaging surface operative when its driven wheel is in driving engagement with the drive wheel to feed the web exiting from the first web feed roller toward the processing equipment, said second web guide means including web folding means engaging the web at a location between the first web feed roller and the second web feed roller for longitudinally folding the web of material to form a folded web, said folded web being guided around said second web feed roller.

2. A tension controlled apparatus for feeding a web of material from a supply roll to processing equipment of the type that exerts an intermittent pulling force on the web to intermittently advance the web through the processing equipment, the apparatus including means for supporting a supply roll of web material for unwinding rotation, a first web feed roller mounted for axial rotation, a first web guide means for guiding the web after it unwinds from the supply roll to cause it to wrap part way around the first web feed roller, means for driving the first web feed roller in continuous fashion in a direction to feed the web passing thereover from the supply roll, the first web feed roller having a smooth low friction web engaging surface operative to feed the web passing thereover when the tension on the web exceeds a minimum value and to slip relative to the web when the web tension decreases below the minimum value, a drive wheel mounted for axial rotation and drive means for driving said drive wheel in continuous fashion, a driven wheel mounted for rotation about an axis parallel to said drive wheel and for shifting movement bodily along a path toward and away from said drive wheel, a second web feed roller connected coaxially to said driven wheel for rotation thereby, second web guide means for guiding the web of material to cause it to wrap part way around the second web feed roller as it passes from the first web feed roller to the processing equipment and exit from the second web feed roller in an exiting direction having a substantial component along said path and in a direction to shift the driven wheel along said path and into driving engagement with the drive wheel when tension is applied by the processing equipment on the web material exiting from the second web feed roller, the second web feed roller having high friction web engaging surface operative when its driven wheel is in driving engagement with the drive wheel to feed the web exiting from the first web feed roller toward the processing equipment, said second web guide means including an idler roller mounted for free axial rotation about an axis coaxial with said drive wheel and juxtaposed to said second web feed roller so that the web of material makes an S-wrap around the idler and second web feed rollers.

3. A tension controlled apparatus for feeding a web of material from a supply roll to processing equipment of the type that exerts an intermittent pulling force on the web to intermittently advance the web through the processing equipment, the apparatus including means for supporting a supply roll of web material for unwinding rotation, a first web feed roller mounted for axial rotation, a first web guide means for guiding the web after it unwinds from the supply roll to cause it to wrap part way around the first web feed roller, means for driving the first web feed roller in continuous fashion in a direction to feed the web passing thereover from the supply roll, the first web feed roller having a smooth low friction web engaging surface operative to feed the web passing thereover when the tension on the web exceeds a minimum value and to slip relative to the web when the web tension decreases below the minimum value, a drive wheel mounted for axial rotation and drive means for driving said drive wheel in continuous fashion, a driven wheel mounted for rotation about an axis parallel to said drive wheel and for shifting movement bodily along a path toward and away from said drive wheel, a second web feed roller connected coaxially to said driven wheel for rotation thereby, second web guide means for guiding the web of material to cause it to wrap part way around the second web feed roller as it passes from the first web feed roller to the processing equipment and exit from the second web feed roller in an exiting direction having a substantial component along said path and in a direction to shift the driven wheel along said path and into driving engagement with the drive wheel when tension is applied by the processing equipment on the web material exiting from the second web feed roller, the second web feed roller having a high friction web engaging surface operative when its driven wheel is in driving engagement with the drive wheel to feed the web exiting from the first web feed roller toward the processing equipment, said second web guide means including an idler roller mounted for free axial rotation about an axis coaxial with said drive wheel and juxtaposed to said second web feed roller, and web folding means engaging the web at a location between the first web roller and the second web feed roller for longitudinally folding the web of material to form a folded web, said folded web being guided so that it makes an S-wrap around the idler and second web feed rollers.

4. A tension controlled apparatus for feeding a plurality of webs of material from a plurality of supply rolls to a multi-lane wrapping machine of the type that exerts an intermittent pulling force on the webs to intermittently advance the webs through the wrapping machine, the apparatus including means for supporting a plurality of supply rolls of web material for unwinding rotation, a plurality of first web feed rollers mounted for axial rotation, a first web guide means for guiding the webs after they unwind from the supply rolls to cause them to wrap part way around a respective one of the first web feed rollers, means for driving the first web feed rollers in continuous fashion in a direction to feed the web passing thereover from the respective supply roll, said first web feed rollers having a smooth low friction web engaging surface operative to feed the web passing thereover when the tension on the web exceeds a minimum value and to slip relative to the web when the web tension decreases below the minimum value, a plurality of drive wheels each individual to a respective lane of the wrapping machine, drive means for driving said plurality of drive wheels in continuous fashion, a driven wheel associated with each drive wheel and mounted for rotation about an axis parallel thereto and for shifting movement along a path toward and away from the associated drive wheel, a second web feed roller connected coaxially to each driven wheel for rotation thereby, second web guide means for guiding said webs of material to cause each web to wrap part way around a respective one of the second web feed rollers as it passes from the respective one of the first web feed rollers to the wrapping machine and exit therefrom in an exiting direction having a substantial component in a direction to shift the driven wheel connected thereto into driving engagement with its associated drive wheel when tension is applied by the wrapping machine on the webs exiting from the second web feed roller, the second web feed rollers having a high friction web engaging surface operative, when their driven wheels are in driving engagement with the associated drive wheel to feed the web exiting from the respective first feed roller toward the wrapping machine, said second web guide means including a plurality of web folding means each engaging a respective one of the webs at a location between the first web feed roller and the respective second web feed roller for longitudinally folding the web of material to form a folded web, the folded webs being guided to wrap part way around the respective second web feed roller.

5. A tension controlled apparatus according to claim 4 wherein at least some of said first feed rollers are mounted coaxially on a common shaft.

6. A tension controlled apparatus according to claim 4 wherein said drive and driven wheels are wedge surfaced friction wheels.

7. A tension controlled apparatus for feeding a plurality of webs of material from a plurality of supply rolls to a multi-lane wrapping machine of the type that exerts an intermittent pulling force on the webs to intermittently advance the webs through the wrapping machine, the apparatus including means for supporting a plurality of supply rolls of web material for unwinding rotation, a plurality of first web feed rollers mounted for axial rotation, a first web guide means for guiding the webs after they unwind from the supply rolls to cause them to wrap part way around a respective one of the first web feed rollers, means for driving the first web feed rollers in continuous fashion in a direction to feed the web passing thereover from the respective supply roll, said first web feed rollers having a smooth low friction web engaging surface operative to feed the web passing thereover when the tension on the web exceeds a minimum value and to slip relative to the web when the web tension decreases below the minimum value, a plurality of drive wheels each individual to a respective lane of the wrapping machine, drive means for driving said plurality of drive wheels in continuous fashion, a driven wheel associated with each drive wheel and mounted for rotation about an axis parallel thereto and for shifting movement along a path toward and away from the associated drive wheel, a second web feed roller connected coaxially to each driven wheel for rotation thereby, second web guide means for guiding said webs of material to cause each web to wrap part way around a respective one of the second web feed rollers as it passes from the respective one of the first web feed rollers to the wrapping machine and exit therefrom in an exiting direction having a substantial component in a direction to shift the driven wheel connected thereto into driving engagement with its associated drive wheel when tension is applied by the wrapping machine on the webs exiting from the second web feed roller, the second web feed rollers having a high friction web engaging surface operative, when their driven wheels are in driving engagement with the associated drive wheel, to feed the web exiting from the respective first feed roller toward the wrapping machine, said second web guide means including an idler roller mounted for free axial rotation about an axis coaxial with each drive wheel and juxtaposed to an associated one of the second web feed rollers to cause the web to make an S-wrap around the associated idler and second web feed rollers.

8. A tension controlled apparatus for feeding a plurality of webs of material from a plurality of supply rolls to a multi-lane wrapping machine of the type that exerts an intermittent pulling force on the webs to intermittently advance the webs through the wrapping machine, the apparatus including means for supporting a plurality of supply rolls of web material for unwinding rotation, a plurality of first web feed rollers mounted for axial rotation, a first web guide means for guiding the webs after they unwind from the supply rolls to cause them to wrap part way around a respective one of the first web feed rollers, means for driving the first web feed rollers in continuous fashion in a direction to feed the web passing thereover from the respective supply roll, said first web feed rollers having a smooth low friction web engaging surface operative to feed the web passing thereover when the tension on the web exceeds a minimum value and to slip relative to the web when the web tension decreases below the minimum value, a plurality of drive wheels each individual to a respective lane of the wrapping machine, drive means for driving said plurality of drive wheels in continuous fashion, a driven wheel associated with each drive wheel and mounted for rotation about an axis parallel thereto and for shifting movement along a path toward and away from the associated drive wheel, a second web feed roller connected coaxially to each driven wheel for rotation thereby, second web guide means for guiding said webs of material to cause each web to wrap part way around a respective one of the second web feed rollers as it passes from the respective one of the first web feed rollers to the wrapping machine and exit therefrom in an exiting direction having a substantial component in a direction to shift the driven wheel connected thereto into driving engagement with its associated drive wheel when tension is applied by the wrapping machine on the webs exiting from the second web feed roller, the second web feed rollers having a high friction web engaging surface operative, when their driven wheels are in driving engagement with the associated drive wheel, to feed the web exiting from the respective first feed roller toward the wrapping machine, said second web guide means including an idler roller mounted for free axial rotation about an axis coaxial with each drive wheel and juxtaposed to an associated one of the web feed rollers, and a web folding means individual to each web and engaging the same at a location between the first web feed roller and the respective second web feed roller for longitudinally folding the web of material to form a folded web, the folded webs being guided to make an S-wrap around the associated idler and second web feed rollers.

* * * * *

UNITED STATES PATENT AND TRADEMARK OFFICE

CERTIFICATE OF CORRECTION

PATENT NO. : 4,231,560

DATED : November 4,1980

INVENTOR(S) : Roger H. Stohlquist; Leo Strombeck

It is certified that error appears in the above-identified patent and that said Letters Patent are hereby corrected as shown below:

Claim 1 , Column 7, line 9, "exciting" should be -- exiting --.

Signed and Sealed this

*Third* Day of *March 1981*

[SEAL]

*Attest:*

RENE D. TEGTMEYER

*Attesting Officer*

*Acting Commissioner of Patents and Trademarks*